US009593524B2

(12) United States Patent
Rasmussen et al.

(10) Patent No.: US 9,593,524 B2
(45) Date of Patent: Mar. 14, 2017

(54) WINDOW MOUNTING SYSTEM

(71) Applicant: Rockwool International A/S, Hedehusene (DK)

(72) Inventors: Jesper Rene Rasmussen, Roskilde (DK); Klavs Koefoed Jakobsen, Roskilde (DK); Hans Henrik Ter-Borch, Holbaek (DK); Kristian Skovgaard Jorgensen, Roskilde (DK)

(73) Assignee: Rockwool International A/S (DK)

( * ) Notice: Subject to any disclaimer, the term of this patent is extended or adjusted under 35 U.S.C. 154(b) by 0 days.

(21) Appl. No.: 14/434,238

(22) PCT Filed: Oct. 7, 2013

(86) PCT No.: PCT/EP2013/070784

§ 371 (c)(1),
(2) Date: Apr. 8, 2015

(87) PCT Pub. No.: WO2014/056823

PCT Pub. Date: Apr. 17, 2014

(65) Prior Publication Data

US 2015/0275565 A1 Oct. 1, 2015

(30) Foreign Application Priority Data

Oct. 8, 2012 (EP) ..... 12187703

(51) Int. Cl.
*E06B 1/32* (2006.01)
*E06B 1/02* (2006.01)
(Continued)

(52) U.S. Cl.
CPC ..... *E06B 1/32* (2013.01); *E04B 1/7641* (2013.01); *E06B 1/02* (2013.01); *E06B 1/36* (2013.01);
(Continued)

(58) Field of Classification Search
CPC ..... E06B 1/32; E06B 1/36; E06B 1/02; E06B 1/62; E06B 1/363; E06B 7/00;
(Continued)

(56) References Cited

U.S. PATENT DOCUMENTS 1,214,057 A * 1/1917 Moore ..... E06B 7/28 454/196
2,074,872 A * 3/1937 Thorin ..... A47B 71/00 47/40
(Continued)

FOREIGN PATENT DOCUMENTS

DE 3821499 11/1989
DE 29715499 U1 10/1997
(Continued)

OTHER PUBLICATIONS

EPO communication to corresponding EP patent application No. 13774135.1, dated Nov. 10, 2015, 4 pages.

*Primary Examiner* — Joshua J Michener
*Assistant Examiner* — Theodore Adamos
(74) *Attorney, Agent, or Firm* — Tarolli, Sundheim, Covell & Tummino LLP

(57) ABSTRACT

The invention relates to a window mounting system comprising: a building facade having an interior face and an exterior face and comprising a window opening; and a window mounting collar formed from rigid thermal insulating material, the mounting collar having at least one inside face, at least one outside face, a first open end and a second open end; wherein the window mounting collar is affixed to the exterior face of the building facade so as to surround the window opening and extend outwards from the exterior face of the facade, such that the first end of the mounting collar is proximal to the building facade and the second end of the mounting collar is distal from the building facade; wherein the system further comprises a window frame arranged in
(Continued)

the mounting collar such that the window frame is separated from the plane of the exterior face of the building facade by at least 10 mm.

7 Claims, 5 Drawing Sheets

(51) Int. Cl.
*E06B 1/60* (2006.01)
*E04B 1/76* (2006.01)
*E06B 1/36* (2006.01)
*E06B 7/00* (2006.01)

(52) U.S. Cl.
CPC ..... *E06B 1/6015* (2013.01); *E06B 1/6069* (2013.01); *E06B 7/00* (2013.01)

(58) Field of Classification Search
CPC ..... E06B 1/6069; E06B 1/6015; E04D 13/02; E04D 13/03; E04D 13/0305; E04D 13/031; E04D 13/0315; E04B 1/76; E04B 1/7641
USPC ... 52/204.1, 210, 216, 217, 126.1, 200, 201, 52/745.15; 248/237, 208, 220.1, 220.22, 248/226.11, 227.3, 274.1, 295.11, 597.21
See application file for complete search history.

(56) References Cited

U.S. PATENT DOCUMENTS 2,302,736 A * 11/1942 Bates ..... E04F 13/06 160/270
2,713,896 A * 7/1955 Kehne ..... E06B 1/36 160/92
3,350,830 A * 11/1967 Smith, Jr. ..... E04F 13/0855 52/134
4,193,232 A * 3/1980 Almsted ..... E06B 3/28 49/61
4,324,071 A * 4/1982 Ishida ..... E06B 1/18 49/63
4,411,111 A * 10/1983 Hosooka ..... E06B 1/32 49/504
4,579,774 A * 4/1986 Kuwazuru ..... B29C 70/086 428/300.4
4,603,517 A * 8/1986 Lyons, Jr. ..... E04D 13/1407 52/219
4,750,302 A * 6/1988 Bechtold ..... E04D 13/0354 52/200
4,920,713 A * 5/1990 Borresen ..... E04D 13/031 206/325
4,972,638 A * 11/1990 Minter ..... E04D 13/1475 52/200
5,063,717 A * 11/1991 Quaranta ..... E06B 1/363 52/201
5,199,234 A * 4/1993 Guhl ..... E04D 13/0315 52/200
5,265,396 A * 11/1993 Amimoto ..... E04F 13/0855 52/235
5,400,557 A * 3/1995 Glover ..... E05F 11/16 49/339
5,457,922 A * 10/1995 Fara ..... E04G 21/24 312/1
5,544,455 A * 8/1996 DeBlock ..... E04B 9/32 52/200
5,682,713 A * 11/1997 Weiss ..... E04D 13/031 403/231
5,685,112 A * 11/1997 Fara ..... E04G 21/24 312/1
5,749,183 A * 5/1998 Wright ..... E06B 1/363 248/323
5,806,255 A * 9/1998 Verby ..... E04D 13/0315 52/200
5,921,191 A * 7/1999 Gabel ..... E05C 7/002 109/13
6,098,364 A * 8/2000 Liu ..... E04F 13/0855 52/235
6,263,623 B1 * 7/2001 Weiss ..... E04D 13/02 49/463
6,729,082 B1 * 5/2004 Oldham ..... E06B 1/363 52/201
7,104,015 B2 * 9/2006 Huynh ..... E06B 5/00 49/63
7,331,145 B2 * 2/2008 Feucht ..... E04D 13/02 52/200
8,782,974 B1 * 7/2014 Potts ..... E06B 1/10 52/204.1
8,833,025 B2 * 9/2014 Krause ..... E04F 13/0828 52/235
8,943,767 B2 * 2/2015 Lewis ..... E04D 13/0335 52/20
2003/0145531 A1 * 8/2003 Holder ..... E04F 13/0853 52/98
2005/0086878 A1 * 4/2005 Feucht ..... E04D 13/031 52/200
2006/0096213 A1 * 5/2006 Griffin ..... E04C 2/296 52/409
2006/0191223 A1 * 8/2006 Bontrager ..... E04D 11/02 52/411
2010/0139186 A1 * 6/2010 Laremore ..... E04D 13/0315 52/200
2011/0154753 A1 * 6/2011 Furgerson ..... E06B 1/28 52/204.1
2011/0296777 A1 * 12/2011 Matta ..... E06B 1/342 52/208
2012/0112383 A1 * 5/2012 Nemazi ..... B29C 70/76 264/263
2012/0167495 A1 * 7/2012 Lindgren ..... E04D 13/031 52/200
2012/0190262 A1 * 7/2012 Rosenberg ..... D04H 1/4209 442/327
2012/0211636 A1 8/2012 Sirek et al.
2014/0202525 A1 * 7/2014 Janssens ..... F24J 2/5256 136/251

FOREIGN PATENT DOCUMENTS

DE 29905365 U1 9/1999
DE 20005237 10/2000
DE 202006004425 U1 6/2006
DE 202008016538 U1 3/2009
EP 1500767 1/2005
EP 2226456 9/2010
WO 2011012712 A1 2/2011

* cited by examiner

WINDOW MOUNTING SYSTEM

FIELD OF THE INVENTION

This invention relates to a mounting system for mounting windows onto a building façade. The invention also relates to methods for mounting windows onto a building façade and to an insulated building.

BACKGROUND OF THE INVENTION

When building façades are insulated with external wall insulation, the window frames of the building can act as a thermal bridge, because the window frames are generally not covered by the external wall insulation. Heat can, therefore, escape from the building by passing from the building interior through the building wall, into the window frame and to the exterior of the building. Such thermal bridges can undermine the benefit of the new insulation.

In order to reduce the thermal bridging effect of the window frames, the windows are often replaced when the external wall insulation is installed. The new windows are often shifted outwards and arranged so that they are in line with the new façade front. This reduces thermal bridging by preventing contact between the window frame and the building wall itself.

However, in order to fix the new windows in place securely, in particular so that the building meets fire regulations, it is often necessary to fix the window in its new position with brackets, which are attached to the window frame at one end and the reveal or window opening in the building wall at the other. In order to provide sufficient support for the window frame, these brackets must be very strong. They are, therefore, generally metal brackets which form a thermal bridge between the window frame and the building wall. Furthermore, since the brackets are attached to the reveal of the building wall, it is necessary to remove the existing window frame before installing the new window frame. This is undesirable, because it leaves the building open to the elements for a period of time. That is particularly problematic when the building remains occupied during the installation process, as is often the case.

DE 20 2008 016 538 U1 discloses an assembly for installation into an opening in a building wall, which includes a facing frame, made from thermally insulating material, which is secured to a frame arranged in the opening of the building wall. The window frame is mounted within the insulating frame.

In this assembly, the insulating frame is attached to the frame arranged in the opening of the building wall. There is also no separation between the plane of the face of the building façade and the window frame. These features make installation of a new window impossible before the existing window is removed.

DE 20 2006 000 4425 describes a frame assembly for sealing a building opening such as a window or door, which comprises a prefabricated insulation system that is integrally joined to a window frame. Brackets are used to fix the window frame itself to the building wall. In this system, the window frame is attached directly to the building wall. Therefore, although installation is quick, a thermal bridge is formed. This system also appears to prevent installation of a new window before the existing window has been removed.

DE 299 05 365 U1 describes a prefabricated thermal insulating element to be placed in the opening in a façade-insulating layer that is aligned with an opening in the building wall. The prefabricated element has a reveal element formed from a thermal insulating material that is attached to a window frame. When the prefabricated element is installed, the window frame sits within the opening of the building wall. This positioning of the window frame makes it impossible to install the prefabricated element before any existing window has been removed.

SUMMARY OF THE INVENTION

The disadvantages discussed above are overcome by the present invention, which provides a window mounting system comprising:

- a building façade having an interior face and an exterior face and comprising a window opening; and
- a window mounting collar formed from rigid thermal insulating material, the mounting collar having at least one inside face, at least one outside face, a first open end and a second open end;
- wherein the window mounting collar is affixed to the exterior face of the building façade so as to surround the window opening and extend outwards from the exterior face of the façade, such that the first end of the mounting collar is proximal to the building façade and the second end of the mounting collar is distal from the building façade;
- wherein the system further comprises a window frame arranged in the mounting collar such that the window frame is separated from the plane of the exterior face of the building façade by at least 10 mm.

The invention also provides a method for mounting a window on a building façade having an interior face and an exterior face and a window opening, comprising:

- providing a window mounting collar formed from rigid thermal insulating material, the mounting collar having at least one inside face, at least one outside face, a first open end and a second open end;
- affixing the window mounting collar to the exterior face of the building façade such that the mounting collar surrounds the window opening and extends outwards from the exterior face of the façade, and such that the first end of the mounting collar is proximal to the building façade and the second end of the mounting collar is distal from the building façade;
- mounting a window frame in the window mounting collar such that the window frame is separated from the plane of the exterior face of the building façade by at least 10 mm.

In a third aspect, the invention also provides a method for mounting a window on a building façade having an interior face and an exterior face and a window opening, comprising:

- providing a window mounting collar formed from rigid thermal insulating material, the mounting collar having at least one inside face, at least one outside face, a first open end and a second open end;
- mounting a window frame in the window mounting collar at a distance of at least 10 mm from the first end of the mounting collar;
- affixing the window mounting collar to the exterior face of the building façade such that the mounting collar surrounds the window opening and extends outwards from the exterior face of the façade, and such that the first end of the mounting collar is proximal to the building façade and the second end of the mounting collar is distal from the building façade.

In a fourth aspect, the invention provides an insulated building comprising:

a building façade having an interior face and an exterior face and comprising a window opening; and a window mounting collar formed from rigid thermal insulating material, the mounting collar having at least one inside face, at least one outside face, a first open end and a second open end;

wherein the window mounting collar is affixed to the exterior face of the building façade so as to surround the window opening and extend outwards from the exterior face of the façade, such that the first end of the mounting collar is proximal to the building façade and the second end of the mounting collar is distal from the building façade;

wherein a window frame is arranged in the mounting collar such that the window frame is separated from the plane of the exterior face of the building façade by at least 10 mm; and wherein external wall insulation is affixed to the exterior face of the building façade, surrounding the window mounting collar.

In the invention, it is the rigid insulating material of the mounting collar that is attached to the building façade, rather than the window frame itself. This reduces the degree of thermal bridging. Furthermore, since the window frame is set away from the plane of the face of the building façade, the possibility of thermal bridging is further reduced and it is possible to install the window mounting collar and new window frame prior to removal of any existing window frame. This means that the window openings can remain sealed during the entire installation process.

In the invention, the window frame is separated from the plane of the exterior face of the building façade by at least 10 mm. Preferably, the separation is larger, for example at least 20 mm, at least 30 mm, at least 50 mm, at least 75 mm or at least 100 mm. When the window frame is mounted in the window mounting collar before the collar is affixed to the exterior face of the building façade, this separation can be ensured by mounting the window frame in the window mounting collar at a distance of at least 10 mm, preferably at least 20 mm, at least 30 mm, at least 50 mm, at least 75 mm or most preferably at least 100 mm from the first end of the mounting collar.

The separation between the window frame and the plane of the exterior face of the building façade is the smallest separation between the inner face of the window frame and the plane of the exterior face of the façade. Where the collar does not extend away from the façade in a direction perpendicular to the exterior face of the façade, it is the component of the separation that is perpendicular to the exterior face of the façade that should be considered.

Similarly, the distance from the window frame to the first open end of the mounting collar is the shortest distance from the inner face of the window frame to the first open end of the mounting collar.

The present invention is particularly useful in the context of the installation of external wall insulation on the exterior face of the building façade. Therefore, preferably, external wall insulation is affixed to the exterior face of the building façade, such that the external wall insulation surrounds the window mounting collar. Usually, partly for aesthetic reasons and in order to minimise thermal bridging, it is desirable for the window frame to be arranged so that it is positioned near the second end (furthest from the building façade) of the mounting collar. It is preferred that the window frame is arranged within 50 mm, preferably within 30 mm and more preferably within 10 mm of the second end of the mounting collar. The distance to be considered is the shortest distance between the outer face of the window frame and the second open end of the mounting collar. Most preferably, the window frame is arranged at the second end of the window mounting collar.

The external wall insulation usually has a thickness of at least 50 mm, preferably at least 75 mm and more preferably at least 100 mm. The thickness is normally less than 400 mm, preferably less than 350 mm and more preferably less than 250 mm. The window mounting collar usually has a depth from the first open end to the second open end of at least 50 mm, preferably at least 75 mm and more preferably at least 100 mm. The depth is normally less than 400 mm, preferably less than 350 mm and more preferably less than 250 mm.

Usually, for aesthetic reasons and to minimise thermal bridging, the depth of the window mounting collar substantially matches the thickness of the external wall insulation. Therefore, usually, the separation between the inner face of the window frame and the plane of the exterior face of the façade is larger when thicker external wall insulation is used.

It is preferred that the mounting collar is fixed to the façade surface by brackets attached to the exterior face of the building façade. Fixing the mounting collar with brackets to the exterior face of the building façade, rather than to the reveal of the opening or to a frame in the opening of the building wall allows the mounting collar to be fitted before removal of an existing window frame. The brackets are preferably L-shaped brackets, having two orthogonal arms.

Preferably, one arm is fixed to the exterior face of the building façade and the other arm is fixed to an outside face of the mounting collar. This has been found to be a particularly convenient and efficient way of attaching the mounting frame to the façade. Since the brackets are not attached to the window frame itself, they need not be so long as was previously required to hold the window frame away from the building façade. As a result, in the invention, the brackets are not such a potential point of weakness in the structure.

A new bracket system that is particularly useful in the present invention comprises a bracket part and a holding part. The bracket part comprises a base arm and a second arm, that are substantially perpendicular to each other. In use, the base arm is affixed to the exterior face of the building façade, preferably with screws. In use, the second arm extends outwards from the building façade along an outside face of the mounting collar.

The holding part has an attachment arm that is adapted for attachment to the second arm of the bracket part and a holding arm that is adapted to hold the mounting collar at its second open end. In use, the attachment arm extends along the outside face of the mounting collar. Usually the holding arm is substantially perpendicular to the attachment arm. In one embodiment, the holding arm has a flange at its end furthest from the attachment arm. In use, the flange lies against an inside face of the window mounting collar.

Preferably, the bracket part and the holding part are adapted to be attached to each other so that the distance between the holding arm of the holding part and the base arm of the bracket part can be adjusted according to the depth of the window mounting collar (i.e. the distance between the first open end and the second open end of the window mounting collar). Preferably, the second arm of the bracket part has pre-bored holes and the attachment arm of the holding part has a groove, through which the threaded part of a screw can pass, but the head of the screw cannot. This allows the degree of overlap of the attachment arm of the holding part and the second arm of the bracket part to vary when they are affixed to the mounting collar. Preferably, the attachment arm of the holding part and the second arm of the bracket part have one-way teeth that cooperate with each other.

In one embodiment, the bracket system is a corner bracket system. In this embodiment, the second arm of the bracket part comprises two substantially orthogonal plates, attached at one edge. Preferably, each plate of the second arm is attached to a base arm that is substantially perpendicular to its respective plate of the second arm. The holding part of the corner bracket system comprises a holding arm, in the form of a holding plate, and an attachment arm that is in the form of two orthogonal plates, attached to each other at one edge, and each attached to the holding plate at one end. Preferably, the holding plate is L-shaped and two flanges, perpendicular to each other and perpendicular to the holding plate, extend from edges of the holding plate opposite to the edges of the holding plate attached to the plates of the attachment arm. In use, the flanges lie against two of adjoining inside faces of the mounting collar.

In the bracket system, each arm is, independently, preferably in the form of a plate.

In use, the holding part is positioned with the attachment arm on an outside face of the mounting collar and with the holding arm over the second open end of the mounting collar. The second arm of the bracket part is then slid over or underneath the attachment arm of the holding part so that the base arm of the bracket part is at the first open end of the mounting collar. The holding part and bracket part are then fixed on the mounting collar with screws.

The window mounting system of the present invention is particularly useful where the mounting collar and window frame are replacing a pre-existing window. Therefore, in both method aspects of the invention, the method preferably additionally comprises the subsequent removal of a pre-existing window frame present in the opening of the building wall.

The first method aspect of the invention involves affixing the window mounting collar to the building façade before the window frame is mounted in the mounting collar. This embodiment has the advantage that installation of the mounting collar is simplified due to the reduced weight of the mounting collar in the absence of the window frame.

The second method aspect of the invention involves affixing the mounting collar together with the window frame as a prefabricated element. This reduces the time required for installation of the windows on site.

The window frame is mounted in the mounting collar and can be fixed in place by conventional means. For example, screws could be inserted through the window frame and into the mounting collar. If the material of mounting collar allows the screws to be pulled out too easily, it may be necessary to arrange a plate at the outside face of the mounting collar. A screw can then be inserted through the window frame, through the mounting collar and through the plate to provide a firmer connection. However, if external wall insulation is already in place, then positioning of a plate at the outside face of the mounting collar can be difficult.

Therefore, it has been found to be particularly advantageous to use a new frame mounting clip to mount the window frame in the mounting collar. The frame mounting clip has a base plate and first and second side plates extending from opposite ends of the base plate, substantially perpendicular to the base plate and substantially parallel to each other. The clip can be arranged on the mounting collar at its second end such that the first side plate abuts an inside face of the mounting collar and the second side plate abuts an outside face of the mounting collar. In order to mount the window frame in place, a screw is inserted through the window frame, the first side plate of the mounting clip, through the window mounting collar and through the second side plate of the mounting clip.

This clip allows a stronger attachment of the window frame to the mounting collar and allows easy positioning of the clip, because the base plate of the mounting clip is always easily accessible, even when external wall insulation is in place surrounding the mounting collar.

The clip can be made of any suitable material with sufficient rigidity and strength and that can accept screws. The clip could, for example, be made of metal. However, materials with a lower thermal conductivity are preferred. In one embodiment, the first and second side plates of the clip each comprise a pre-bored hole to accept a screw.

In a preferred embodiment, the first side plate of the window mounting clip is shaped as a wedge, having a thickness at its end furthest from the base plate greater than the thickness of the first side plate of the window mounting clip at its end that is adjoined to the base plate. This allows small adjustments to compensate for the size of a particular window frame and a firm connection between the window frame and the mounting collar. For example, if the window frame is positioned in the collar and there is found to be a gap between the edges of the window frame and the mounting clips, rather than simply bridging the gap with screws (as would be necessary if the clips were not present), the window frame can be pushed further into the collar, where the wedges of the clips become thicker, to close the gaps. This puts less stress on the screws.

In a preferred embodiment, the mounting clip forms one part of a clip system. The clip system comprises a mounting clip as described above, wherein the first side plate is shaped as a wedge, as described above. The clip system also comprises a separate plate. Using this clip system, if the window frame is positioned in the collar and there is found to be a gap between the edges of the window frame and the mounting clips, then the separate plate can be inserted between the window frame and the mounting clip to close the gap. By pushing the separate plate further inwards, larger gaps can be closed, due to the wedge shape of the first plate of the mounting clip. Use of the separate plate as part of the clip system allows minor adjustments to be made without adjusting the positioning of the window frame within the window mounting collar.

In a preferred embodiment, the face of the first side plate of the window mounting clip that faces away from the second side plate has ridges, the peaks of the ridges being substantially parallel to the base plate of the clip; and the separate plate has ridges that are adapted to cooperate with the ridges on the face of the first side plate of the window mounting clip. In one embodiment, the ridges on the first side plate and on the separate plate are one-way teeth.

After the window frame has been positioned, a screw can be inserted that passes through the window frame, through the separate plate and the first side plate of the clip system, through the mounting collar and through the second side plate of the clip system.

The separate plate can be made of any suitably rigid and strong material that can accept screws. The clip could, for example, be made of metal. However, materials with a lower thermal conductivity are preferred.

In one embodiment of the invention, the window mounting collar comprises two side boards, an upper cross board and a lower cross board, each having an inside face and an outside face, wherein each side board is joined orthogonally to the upper and lower cross boards, and wherein mounting collar is arranged such that the inside and outside faces of the boards are generally perpendicular to the exterior face of the building façade. The window openings in existing building façades are very often rectangular. This embodiment of the mounting collar has a rectangular opening at either end, so is particularly suitable for use over rectangular window openings.

Where the window opening has a different shape, it may be necessary to form the mounting collar in a different way, for example using a different number of boards joined at their edges so that each end of the mounting collar forms, for example, a triangle, pentagon, or hexagon, when viewed end-on. In one embodiment, the window mounting collar could even be cylindrical, having a single inside face and a single outside face.

Preferably, the each board has a bending strength of at least 7 $N/m^2$ and a point load resistance of at least 500 kN.

The rigid insulating material can be any insulating material that is sufficiently strong and rigid to support the window frame.

The rigid insulating material preferably has a thermal conductivity, measured in a direction from the first end to the second of the collar, of below 0.150 W/m·K, preferably below 0.100 W/m·K. The thermal conductivity of the rigid insulating material, measured in a direction from its inside face to its outside face, is preferably below 0.150 W/m·K, more preferably below 0.100 W/m·K. The thermal conductivity of the rigid insulating material, measured in a direction from its inside face to its outside face, is often lower than the thermal conductivity, measured in a direction from the first end to the second of the collar. Most preferably, the thermal conductivity of the rigid insulating material, measured in a direction from its inside face to its outside face, is below 0.075 W/m·K.

The rigid insulating material preferably comprises man-made vitreous fibres.

In one embodiment, the rigid insulating material comprises man-made vitreous fibres and binder and has a density of at least 150 $kg/m^3$. Such compressed man-made vitreous fibre boards generally have sufficient rigidity and strength to support window frames without the use of additional brackets attaching the window frame to the building façade directly. It is preferred that the material has a density of at least 200 or at least 300 $kg/m^3$. Usually, the density is less than 600 $kg/m^3$, preferably less than 500 $kg/m^3$.

Particularly suitable man-made vitreous fibre boards are produced according to the method described in WO2011/012712. Preferably, the boards comprise from 1% to 20% binder and from 80 to 99% man-made vitreous fibres.

Compressed man-made vitreous fibre boards have the additional benefit that they are fire-proof. In a preferred embodiment, the man-made vitreous fibre boards are layered to form the sides of the mounting collar. Where at least two man-made vitreous fibre boards are layered at their large surfaces, the bending strength of the mounting frame can be improved, thereby improving the stability of the system.

Alternatively, the mounting collar can be formed from polymeric foam, for example polyurethane foam.

In a further embodiment, the mounting collar is formed from a polymeric foam composite material comprising a polymeric foam and man-made vitreous fibres, wherein at least 50% by weight of the man-made vitreous fibres present in the polymeric foam composite material have a length less than 100 micrometers. Such a polymeric foam composite is discussed in our co-pending application PCT/EP2012/066196.

The weight percentage of fibres in the polymeric foam composite material above or below a given fibre length is measured with a sieving method. A representative sample of the man-made vitreous fibres is placed on a wire mesh screen of a suitable mesh size (the mesh size being the length and width of a square mesh) in a vibrating apparatus. The mesh size can be tested with a scanning electron microscope according to DIN ISO3310. The upper end of the apparatus is sealed with a lid and vibration is carried out until essentially no further fibres fall through the mesh (approximately 30 mins). If the percentage of fibres above and below a number of different lengths needs to be established, it is possible to place several screens with incrementally increasing mesh sizes on top of one another. The fibres remaining on each screen are then weighed.

Preferably, the length distribution of the man-made vitreous fibres present in the polymeric foam composite is such that at least 50% by weight of the man-made vitreous fibres have a length of less than 75 micrometers, more preferably less than 65 micrometers.

Preferably, at least 60% by weight of the man-made vitreous fibres present in the polymeric foam composite have a length less than 100 micrometers, more preferably less than 75 micrometers and most preferably less than 65 micrometers.

Generally, the presence of longer man-made vitreous fibres in the polymeric foam composite is found to be a disadvantage in terms of the viscosity of the foamable composition used to form the foam composite and the ease of mixing. Therefore, it is preferred that at least 80%, or even 85 or 90% of the man-made vitreous fibres present in the polymeric foam composite have a length less than 125 micrometers. Similarly, it is preferred that at least 95%, more preferably at least 97% or 99% by weight of the man-made vitreous fibres present in the polymeric foam composite have a length less than 250 micrometers. The fibres are preferably discontinuous stone fibres. In order to achieve the required length distribution of the fibres, it will usually be necessary for the fibres to be processed further after the standard production method. The further processing will usually involve grinding or milling of the fibres for a sufficient time for the required length distribution to be achieved.

Usually, the fibres present in the polymeric foam composite have an average diameter of from 2 to 7 μm, preferably from 3 to 6 μm. The average fibre diameter is determined for a representative sample by measuring the diameter of at least 200 individual fibres by means of the intercept method and scanning electron microscope or optical microscope (1000× magnification).

Preferably, the foam component of the polymeric foam composite is a polyurethane foam.

As discussed above, the present invention is particularly useful when external wall insulation is being affixed to the exterior surface of the building façade. The external wall insulation can comprise, for example, lamellar man-made vitreous batts, or polymeric foam.

BRIEF DESCRIPTION OF THE DRAWINGS

The invention is described further below with reference to the Figures, which depict non-limiting embodiments of the invention.

DETAILED DESCRIPTION OF THE INVENTION

Figure 1:
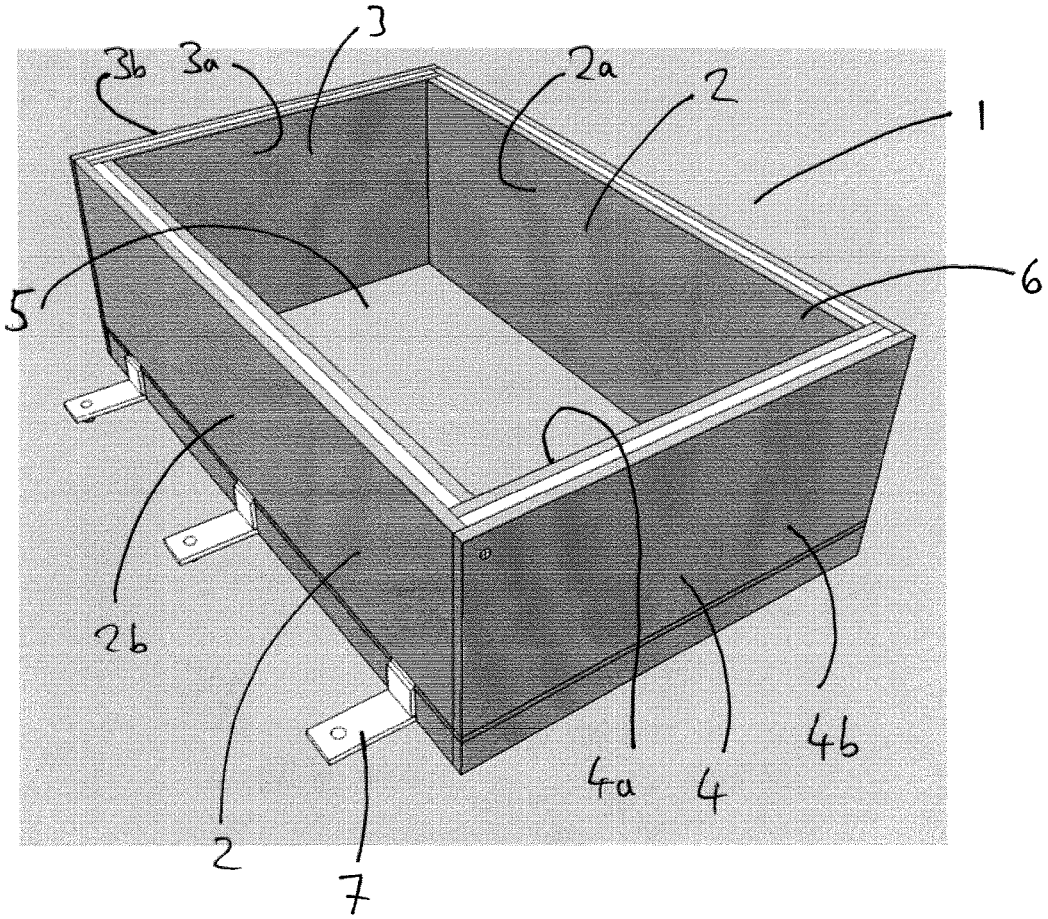
FIG. 1 shows a window mounting collar as used in the invention.

In FIG. 1, a window mounting collar (1) is shown before installation on a building façade. The mounting collar (1) comprises two side boards (2), an upper cross board (3) and a lower cross board (4), each having an inside face (2*a*, 3*a*, 4*a*) and an outside face (2*b*, 3*b*, 4*b*), wherein each side board (2) is joined orthogonally to the upper and lower cross boards (3, 4). The mounting collar has a first open end (5), which, when installed, faces the exterior face of the building façade. The second open end (6) of the mounting collar (1) receives a window frame, which can be installed either before the mounting collar is affixed to the building façade or after the mounting collar has been affixed to the building façade.

In the embodiment shown, the two side boards (2), the upper cross board (3) and the lower cross board (4) are each formed from three layers of man-made vitreous fibre boards, each layer comprising man-made vitreous fibres and binder.

Attached to the mounting collar (1), on its outside faces (2*b*, 3*b*, 4*b*), are brackets (7). In the embodiment shown, the brackets (7) are L-shaped brackets, which are positioned on the outside faces of the mounting collar adjacent to its first open end (5).

Figure 2:
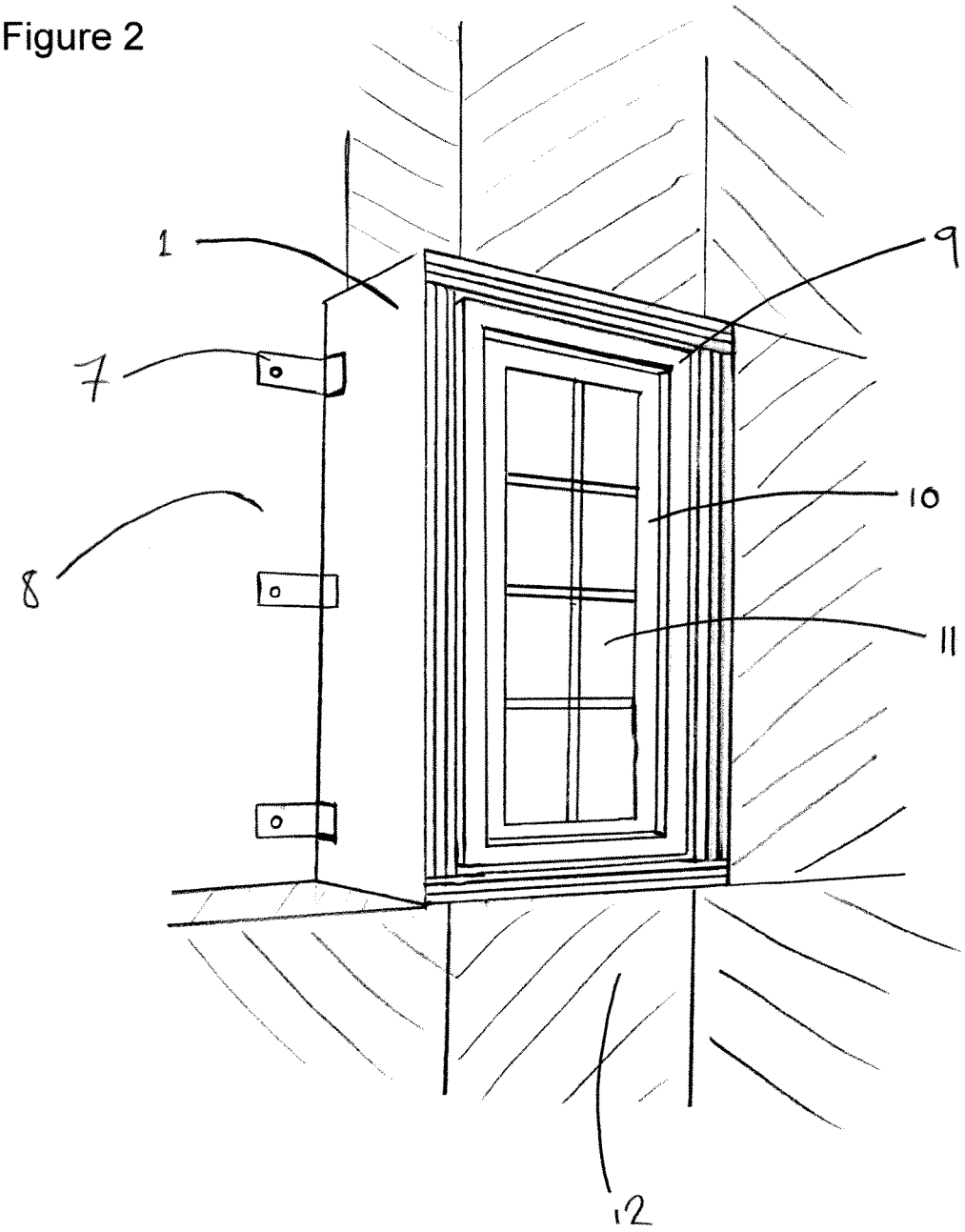
FIG. 2 shows a window mounting system according to the invention.

FIG. 2 shows the mounting collar (1) in place on a building façade (8), as part of a complete window mounting system. Brackets (7) affix the mounting collar (1) to the exterior face of the building façade (8). A window frame (9) is mounted in the mounting collar such that there is a separation (d) (shown in FIG. 3) of at least 10 mm between the window frame (9) and the plane of the exterior face of the building façade (8). The window frame (9) surrounds a window sash (10) and window panes (11). External wall insulation (12) (not shown on one side of the mounting collar) is positioned around the outside of the mounting collar (1) and affixed to the building façade (8). The external wall insulation (12) has the same depth as the mounting collar (1), so the window frame (9) is arranged to be flush with the outer surface of the external wall insulation (12).

Figure 3:
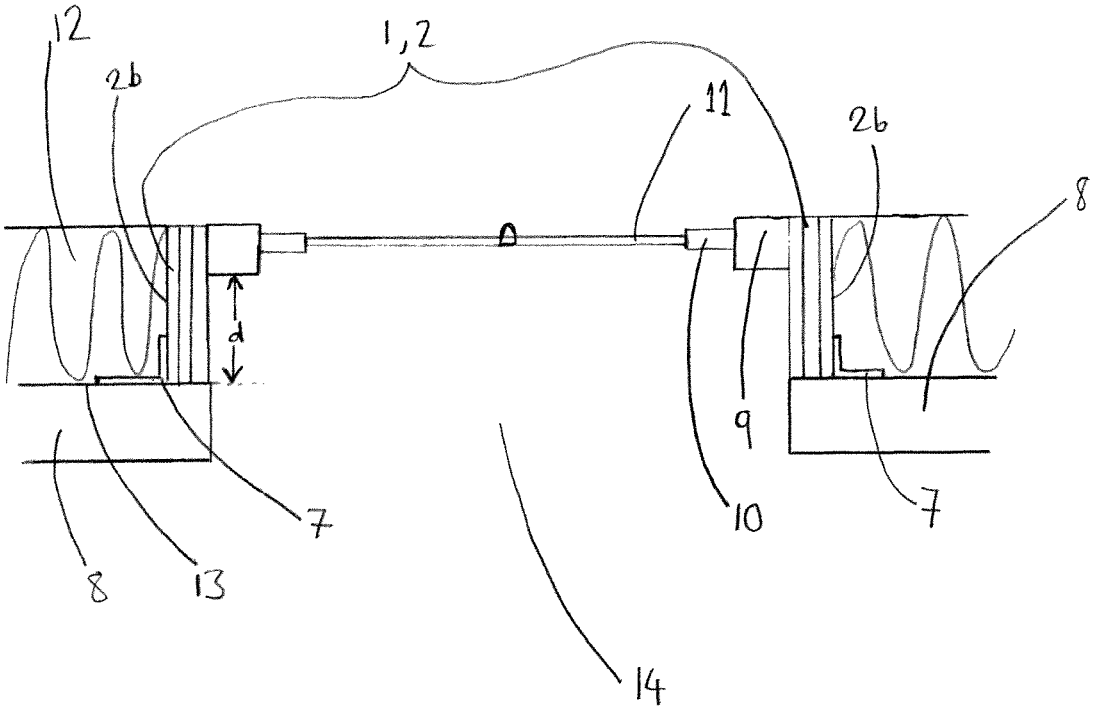
FIG. 3 shows a section through the system of FIG. 1, viewed from above.

FIG. 3 shows a section through the system of FIG. 2, viewed from above. The side boards (2) of the mounting collar (1) are affixed to the exterior face (13) of the building façade (8). The side boards (2) extend perpendicularly outwards from the building façade (8). L-shaped brackets (7) have two perpendicular arms, one of which is attached to an outside face (2*b*) of the mounting collar (1), the other of which is attached to the exterior face (13) of the building façade (8). The separation (d) between the window frame (9) and the plane of the exterior face (13) of the façade allows the mounting collar (1) to be fitted when an existing window is still present in the window opening (14). External wall insulation (12) is present on either side of the mounting frame (1). The mounting collar (1) extends away from the building façade (8) by the same distance as the depth of the external wall insulation (12). Means for attaching the window frame (9) to the mounting collar (1) are not shown, but could, for example, be screws passing through the window frame (9) and into the mounting collar (1).

Figure 4A:
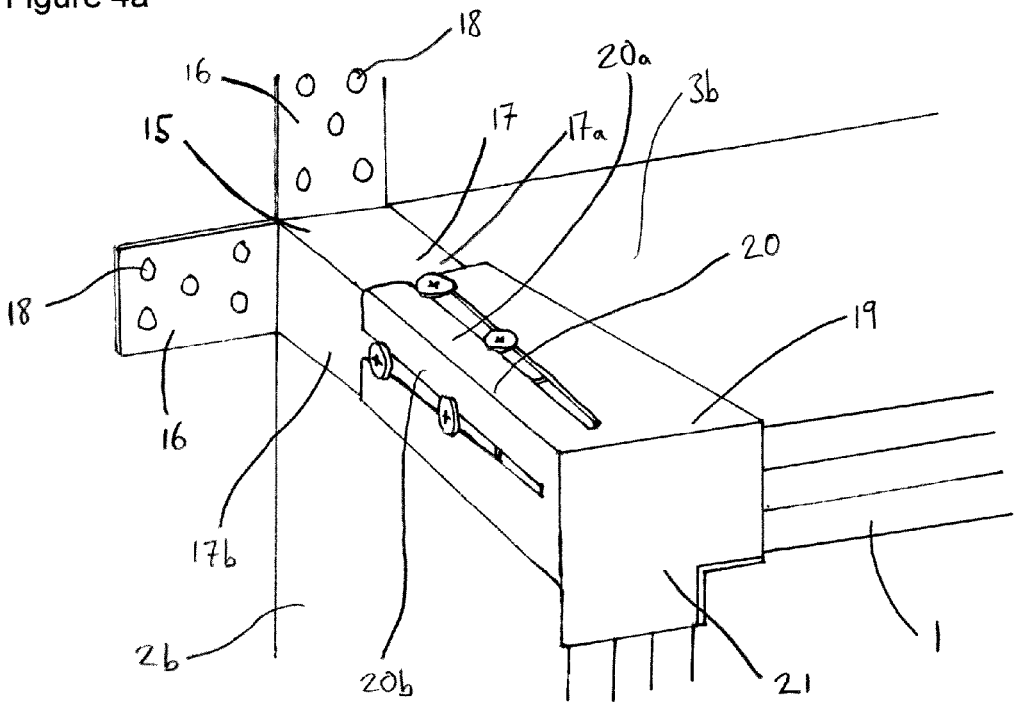
FIGS. 4*a* and 4*b* show a bracket system that can be used in the invention, from two angles.
Figure 4B:
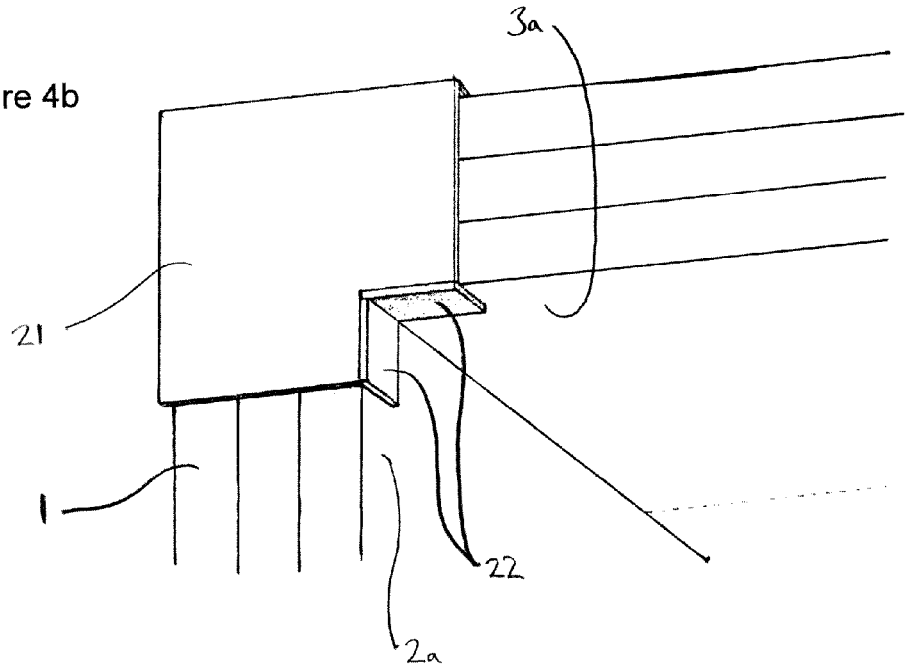

FIG. 4 shows a corner bracket assembly according to an embodiment of the invention. Bracket part (15) has base arms (16) in the form of plates and second arm (17), which comprises two plates (17*a*, 17*b*) that are substantially perpendicular to each other and are joined at one edge. The second arm (17) of the bracket part (15) extends away from the exterior face of the building façade along two of the outside faces (2*b*, 3*b*) of the mounting collar (1). The two base arms (16) of the bracket part (15) each have holes (18) for accepting screws.

Holding part (19) has an attachment arm (20) and a holding arm in the form of holding plate (21). The attachment arm (20) is in the form of two substantially orthogonal plates (20*a*, 20*b*), attached to each other at one edge, and each attached to the holding plate (21) at one end. The holding plate (21) is L-shaped to match the shape of the corner of the mounting collar (1) and has two flanges (22) that are perpendicular to each other and perpendicular to the holding plate (21). The flanges (22) extend from edges of the holding plate (21) opposite to the edges attached to the plates (20*a*, 20*b*) of the attachment arm (20). The flanges (22) lie against two of adjoining inside faces (2*a*, 3*a*) of the mounting collar (1).

Figure 5:
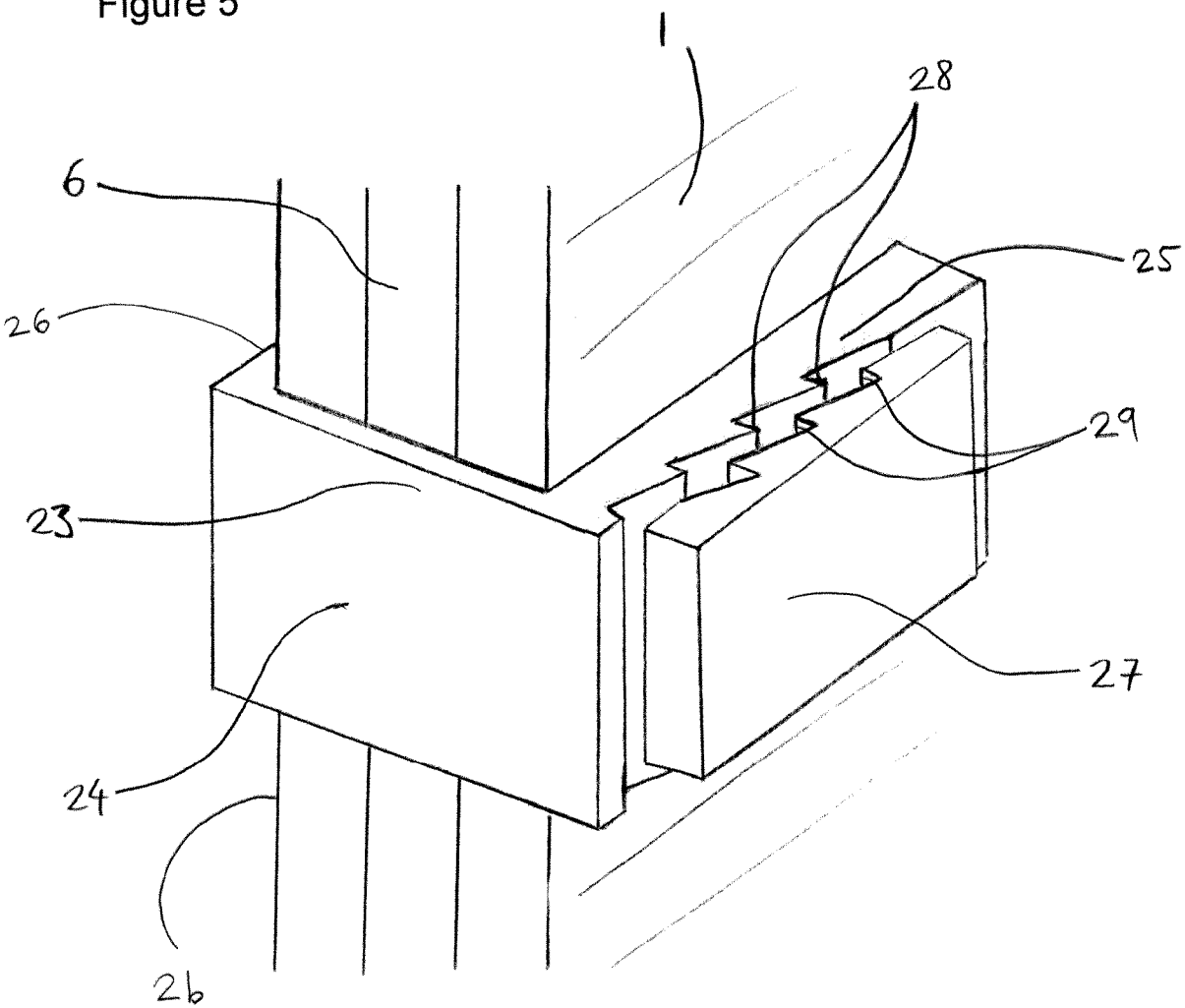
FIG. 5 shows a means by which the window frame can be arranged in the window mounting collar.

FIG. 5 shows a mounting clip system according to the invention. The mounting clip (23) has a base plate (24) and first and second side plates (25, 26) extending from opposite ends of the base plate (24). The clip (23) is shown arranged on the mounting collar (1) at its second end (6) such that the first side plate (25) abuts an inside face (2*a*) of the mounting collar (1) and the second side plate (26) abuts an outside face (2*b*) of the mounting collar (1). The first side plate (25) of the window mounting clip (23) is shaped as a wedge, having a thickness at its end furthest from the base plate (24) that is greater than the thickness of the first side plate (25) of the window mounting clip (23) at its end that is adjoined to the base plate (24).

In the embodiment shown, the mounting clip (23) forms one part of a clip system. The clip system comprises the mounting clip (23) and a separate plate (27). The face of the first side plate (25) of the mounting clip that faces away from the second side plate has ridges (28). The peaks of the ridges are substantially parallel to the base plate (24) of the clip. The clip system also comprises a separate plate (27) having ridges (29) on one of its faces that are adapted to cooperate with the ridges (28) on the first side plate (25) of the mounting clip. A window frame (not shown) can be set in place by positioning the window frame in the mounting collar (1) and then pushing the separate plates (27) in between the window frame and the mounting clip (23). The frame is then fixed in place with screws.

The invention claimed is:

1. A method for mounting a window on a building façade having an interior face and an exterior face and a window opening, comprising:

providing a window mounting collar formed from rigid thermal insulating material, the mounting collar having at least one inside face, at least one outside face, a first open end and a second open end;

affixing the window mounting collar to the exterior face of the building façade such that the mounting collar surrounds the window opening and extends outward from the exterior face of the façade, and such that the first end of the mounting collar is proximal to the building façade and the second end of the mounting collar is distal from the building façade; and after the window mounting collar has been affixed to the exterior face of the building façade, mounting a window frame in the window mounting collar such that the window frame is separated from the plane of the exterior face of the building façade by at least 10 mm;

wherein the window opening contains a window frame being replaced and the method comprises a step of removing the window frame being replaced subsequent to the step of affixing the window mounting collar to the exterior face of the building façade.

2. A method according to claim 1, wherein the window opening remains sealed for the entire duration of the method.

3. A method according to claim 1, wherein the method further comprises affixing external wall insulation to the exterior face of the building façade, such that the external wall insulation surrounds the window mounting collar.

4. A method according to claim 1, wherein mounting a window frame in the window mounting collar includes:

defining a lateral plane with the window frame, the lateral plane including at least one window pane; and locating the window frame entirely laterally adjacent to the mounting collar.

5. A method for mounting a window on a building façade having an interior face and an exterior face and a window opening, comprising:

providing a window mounting collar formed from rigid thermal insulating material, the mounting collar having at least one inside face, at least one outside face, a first open end and a second open end;

mounting a window frame in the window mounting collar at a distance of at least 10 mm from the first end of the mounting collar; and after the window frame has been mounted in the window mounting collar, affixing the window mounting collar to the exterior face of the building façade such that the mounting collar surrounds the window opening and extends outwards from the exterior face of the façade, and such that the first end of the mounting collar is proximal to the building façade and the second end of the mounting collar is distal from the building façade;

wherein the window opening contains a window frame being replaced and the method comprises a step of removing the window frame being replaced subsequent to the step of affixing the window mounting collar to the exterior face of the building façade.

6. A method according to claim 5, wherein the window opening remains sealed for the entire duration of the method.

7. A method according to claim 5, wherein mounting a window frame in the window mounting collar includes:

defining a lateral plane with the window frame, the lateral plane including at least one window pane; and locating the window frame entirely laterally adjacent to the mounting collar.

* * * * *